US009865194B2

(12) United States Patent
Koo et al.

(10) Patent No.: US 9,865,194 B2
(45) Date of Patent: Jan. 9, 2018

(54) DISPLAY SYSTEM AND METHOD FOR DRIVING SAME BETWEEN NORMAL MODE AND PANEL SELF-REFRESH (PSR) MODE

(71) Applicant: SAMSUNG DISPLAY CO., LTD., Yongin-si, Gyeonggi-do (KR)

(72) Inventors: Ja-Hun Koo, Asan-si (KR); Jong-Deuk Moon, Yongin-si (KR); Kyung-Hun Lee, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 15 days.

(21) Appl. No.: 14/991,474

(22) Filed: Jan. 8, 2016

(65) Prior Publication Data

US 2016/0372077 A1 Dec. 22, 2016

(30) Foreign Application Priority Data

Jun. 17, 2015 (KR) ..... 10-2015-0086026

(51) Int. Cl.
*G09G 5/00* (2006.01)
*G09G 3/20* (2006.01)

(52) U.S. Cl.
CPC ..... *G09G 3/2096* (2013.01); *G09G 3/20* (2013.01); *G09G 2310/08* (2013.01); *G09G 2320/0247* (2013.01); *G09G 2320/103* (2013.01); *G09G 2330/021* (2013.01); *G09G 2360/18* (2013.01)

(58) Field of Classification Search
None
See application file for complete search history.

(56) References Cited

U.S. PATENT DOCUMENTS

2012/0206461 A1* 8/2012 Wyatt ..... G09G 5/003 345/501
2013/0235941 A1 9/2013 Koo et al.

FOREIGN PATENT DOCUMENTS

KR 1020110054775 5/2011
KR 1020130018493 2/2013
KR 1020130045608 5/2013

* cited by examiner

*Primary Examiner* — Edward Martello
(74) *Attorney, Agent, or Firm* — F. Chau & Associates, LLC

(57) ABSTRACT

A display system includes a graphic processor and a display apparatus. The graphic processor supplies a first image signal and a first synchronization signal. The display apparatus is driven in a normal mode in which a first image is displayed, during a first period, based on the first image signal and the first synchronization signal provided from the graphic processor and in a panel self refresh (PSR) mode in which a second image is displayed based on a second image signal stored in a frame buffer of the display apparatus and a second synchronization signal generated in the display apparatus, and transmits the second synchronization signal of the PSR mode to the graphic processor when a driving mode of the display apparatus is changed from the PSR mode to the normal mode. The graphic processor is configured to generate the first synchronization signal synchronized with the second synchronization signal.

21 Claims, 10 Drawing Sheets

DISPLAY SYSTEM AND METHOD FOR DRIVING SAME BETWEEN NORMAL MODE AND PANEL SELF-REFRESH (PSR) MODE

This application claims priority under 35 U.S.C. §119 to Korean Patent Application No. 10-2015-0086026, filed on Jun. 17, 2015, in the Korean Intellectual Property Office, the disclosure of which is incorporated by reference herein in its entirety.

TECHNICAL FIELD

The present inventive concept relates to a display system, and more particularly to, a method of driving the display system including a display apparatus.

DISCUSSION OF THE RELATED ART

Pixel resolution in display devices for mobile phones and other electronic devices has been increasing. The display device may receive an image signal from a host through a display drive IC to display a static image. In displaying the static image, memory access and an interface of the host may consume substantial power.

An embedded display port (eDP) standard has recently been released. The eDP standard is an interface standard corresponding to a display port (DP) interface designed for devices equipped with a display such as a laptop/notebook computer, a tablet PC, a netbook, an all-in-one desktop PC, or the like. Particularly, eDP v1.3 standard includes a panel self-refresh (PSR) technology for the purpose of saving power in the display device.

In changing a driving mode of the display device between a normal mode and a PSR mode, a flicker may occur due to a frame rate difference between the two modes.

BRIEF SUMMARY OF THE INVENTION

According to an exemplary embodiment of the present inventive concept, a display system is provided. The display system includes a graphic processor and a display apparatus. The graphic processor is configured to supply a first image signal and a first synchronization signal. The display apparatus is configured to be driven in a normal mode in which a first image is displayed, during a first period, based on the first image signal and the first synchronization signal provided from the graphic processor, to be driven in a panel self refresh (PSR) mode in which a second image is displayed based on a second image signal stored in a frame buffer of the display apparatus and a second synchronization signal generated in the display apparatus, and to transmit the second synchronization signal of the PSR mode to the graphic processor when a driving mode of the display apparatus is changed from the PSR mode to the normal mode. The graphic processor is configured to generate the first synchronization signal synchronized with the second synchronization signal.

In an exemplary embodiment of the present inventive concept, the display apparatus may include a timing controller configured to transmit the second synchronization signal to the graphic processor.

In an exemplary embodiment of the present inventive concept, the graphic processor may be configured to generate a third synchronization signal during a second period disposed between the PSR mode and the first period of the normal mode. A frame rate of the third synchronization signal may gradually increase from a first frame rate corresponding to the second synchronization signal to a second frame rate corresponding to the first synchronization signal during a second period of the normal mode disposed between the PSR mode and the first period of the normal mode.

In an exemplary embodiment of the present inventive concept, the first image signal may be transmitted through a main channel, and the first synchronization signal may be transmitted through an auxiliary channel.

In an exemplary embodiment of the present inventive concept, the second synchronization signal may be transmitted through the main channel or the auxiliary channel.

In an exemplary embodiment of the present inventive concept, the first image signal and the first synchronization signal may be transmitted through an interface based on a display port (DP) standard.

In an exemplary embodiment of the present inventive concept, the first image may include a moving image, and the second image may include a static image.

According to an exemplary embodiment of the present inventive concept, a method of driving a display apparatus is provided. The method includes driving the display apparatus in a first period of a normal mode in which a first image is displayed based on a first image signal and a first synchronization signal provided by a graphic processor, driving the display apparatus in a panel self refresh (PSR) mode in which a second image signal stored in a frame buffer of the display apparatus is displayed based on a second synchronization signal generated in the display apparatus, transmitting the second synchronization signal to the graphic processor when a driving mode of the display apparatus is changed from the PSR mode to the normal mode, and receiving the first synchronization signal synchronized with the second synchronization signal from the graphic processor.

In an exemplary embodiment of the present inventive concept, the method may further include receiving a third synchronization signal whose frame rate gradually increases from a first frame rate corresponding to the second synchronization signal to a second frame rate corresponding to the first synchronization signal during a second period of the normal mode disposed between the PSR mode and the first period of the normal mod.

In an exemplary embodiment of the present inventive concept, the first image signal may be transmitted through a main channel, and the first synchronization signal may be transmitted through an auxiliary channel.

In an exemplary embodiment of the present inventive concept, the second synchronization signal may be transmitted through the main channel or the auxiliary channel.

In an exemplary embodiment of the present inventive concept, the first image signal and the first synchronization signal may be transmitted through an interface based a display port (DP) standard.

According to an exemplary embodiment of the present inventive concept, a method of driving a display system including a graphic processor and a display apparatus is provided. The method includes detecting, using the graphic processor, a driving mode of the display apparatus by detecting a predetermined value of a mode register of the display apparatus, receiving an entry command apparatus from the graphic processor using a first receiver of the display, changing the driving mode from a normal mode, in which a first image is displayed, to a panel self refresh (PSR) mode, in which a second image is displayed, in response to the received entry command, storing a second image signal corresponding to the second image to a buffer in response to a PSR packet received from the graphic processor through the first receiver, receiving an off-command from the graphic processor using the display apparatus, turning off the first receiver connected to the graphic processor through a main channel in response to the received off-command, maintaining a turn-on state of a second receiver of the display apparatus in response to the received off command, generating a first synchronization signal of the PSR mode based on a clock signal generated in the display apparatus, and displaying the second image through a display panel of the display apparatus when the first receiver is turned off. The second receiver is connected to the graphic processor through an auxiliary channel.

In an exemplary embodiment of the present inventive concept, the first image may be a moving image, and the second image may be a static image.

In an exemplary embodiment of the present inventive concept, the PSR packet may be transmitted during a vertical blanking period of a frame of the PSR mode.

In an exemplary embodiment of the present inventive concept, the method may further include changing the driving mode of the display apparatus from the PSR mode to a normal mode in response to an exit command received from the graphic processor, and turning on the first receiver in response to an on-command received from the graphic processor.

In an exemplary embodiment of the present inventive concept, the method may further include transmitting, using the display apparatus, the first synchronization signal of the PSR mode to the graphic processor, and generating, using the graphic processor, a second synchronization signal of the normal mode based on the first synchronization signal.

In an exemplary embodiment of the present inventive concept, the second synchronization signal may be synchronized with the first synchronization signal.

BRIEF DESCRIPTION OF THE DRAWINGS

The above and other features and aspects of the present inventive concept will become more apparent by describing in detailed exemplary embodiments thereof with reference to the accompanying drawings, in which.

DETAILED DESCRIPTION OF THE EMBODIMENTS

Figure 1:
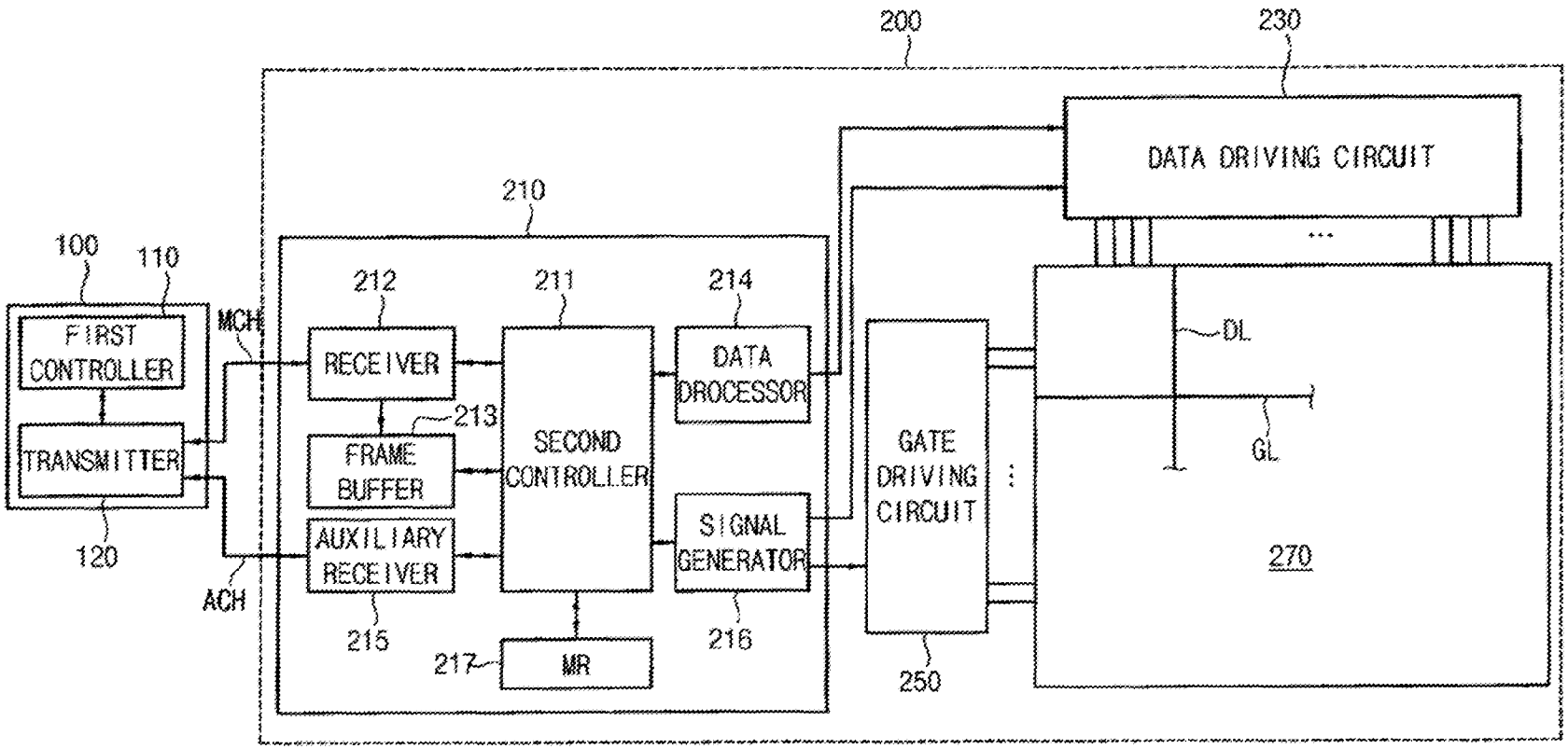
FIG. 1 is a block diagram illustrating a display system according to an exemplary embodiment of the present inventive concept.

Hereinafter, the present inventive concept will be described in detail with reference to the accompanying drawings. The present inventive concept may, however, be embodied in many different forms and should not be construed as being limited to the embodiments set forth herein. Like reference characters or numerals may refer to like elements throughout the specification and drawings.

As used herein, the singular forms "a", "an" and "the" are intended to include the plural forms as well, unless the context clearly indicates otherwise.

FIG. 1 is a block diagram illustrating a display system according to an exemplary embodiment of the present inventive concept.

Referring to FIG. 1, the display system may include a graphic processor 100 and a display apparatus 200. The graphic processor 100 and the display apparatus 200 may use a display port (DP) interface standard such as DP 1.2a, DP 1.3, embedded DP (eDP) 1.3, eDP1.4, or the like.

The graphic processor 100 may include a first controller 110 and a transmitter 120.

The first controller 110 is configured to generate a mode command corresponding to a normal mode in which the display apparatus 200 displays a normal image, or a mode command corresponding to a panel self refresh (PSR) mode in which the display apparatus 200 displays a static image (e.g., a refresh image) based on a mode control signal. The static image may include a text graphic in a state before a text or a cursor is updated when editing a text document. The normal image may include an image that is not a static image. For example, the normal image may include a moving image.

The first controller 110 is configured to generate a synchronization signal of the normal mode. The synchronization signal of the normal mode is synchronized with a synchronization signal of the PSR mode based on synchronization data of the PSR mode. The synchronization data of the PSR mode may include a frame rate and a synchronization signal of the PSR mode transmitted from the display apparatus 200 when a driving mode of the display apparatus 200 is changed from the PSR mode to the normal mode. The synchronization signal (e.g., synchronization signal of the PSR mode or the synchronization signal of the normal mode) may include a horizontal synchronization signal, a vertical synchronization signal, a data enable signal, or the like.

The transmitter 120 is configured to transmit an image signal, a synchronization signal and a command through a main channel MCH and an auxiliary channel ACH based on a predetermined interface mode to the display apparatus 200. For example, the image signal may be transmitted through the main channel MCH. The synchronization signal and the command may be transmitted through the auxiliary channel ACH.

The display apparatus 200 may include a timing controller 210, a data driving circuit 230, a gate driving circuit 250 and a display panel 270.

The timing controller 210 may include a second controller 211, a receiver 212, a frame buffer 213, a data processor 214, an auxiliary receiver 215, a signal generator 216 and a mode register (MR) 217.

The second controller 211 is configured to control an operation of the timing controller 210. The second controller 211 is configured to control the timing controller 210 such that the timing controller 210 transmits the synchronization data (e.g., the frame rate and the synchronization signal of the PSR mode) of the PSR mode to the graphic processor 100 when the driving mode of the display apparatus 200 is changed from the PSR mode to the normal mode.

The receiver 212 is connected to the transmitter 110 of the graphic processor 100 through the main channel MCH. The receiver 212 is configured to receive the image signal from the graphic processor 100 through the main channel MCH. In addition, the receiver 212 may transmit the synchronization data (e.g., the frame rate and the synchronization signal of the PSR mode) of the PSR mode to the graphic processor 100 when the driving mode of the display apparatus 200 is changed from the PSR mode to the normal mode.

The frame buffer 213 is configured to store a static image signal corresponding to the static image received through the receiver 212. In the PSR mode, the display apparatus 200 displays the static image using the static image signal stored in the frame buffer 213.

The data processor 214 is configured to process an image signal (e.g., the static image signal) to correspond to a resolution of the display panel 270. In addition, the data processor 214 is configured to compensate the image signal using various algorithms and to provide the data driving circuit 230 with the compensated image signal DATA.

The auxiliary receiver 215 is connected to the transmitter 110 of the graphic processor 100 through the auxiliary channel ACH. The auxiliary receiver 215 transmits the synchronization signal and the command to the graphic processor 100 through the auxiliary channel ACH and receives the synchronization signal and the command from the graphic processor 100 through the auxiliary channel ACH.

In the normal mode, the signal generator 216 is configured to generate a synchronization signal for displaying the normal image in the display panel 270 based on the synchronization signal received through the auxiliary receiver 215 from the graphic processor 100. For example, the synchronization signals for driving the data driving circuit 230 and the gate driving circuit 250 may include a data enable signal, a vertical synchronization signal, a horizontal synchronization signal, a clock signal, a vertical start signal, or the like.

In the PSR mode, the signal generator 216 is configured to generate a synchronization signal for displaying the static image in the display panel 270 based on a clock signal generated from an oscillator of the display apparatus 200.

The mode register (MR) 217 is configured to store predetermined values respectively corresponding to driving modes (e.g., the normal mode and the PSR mode) of the display apparatus 200. The display apparatus 200 may be driven according to a driving mode corresponding to a predetermined value stored in the mode register 217.

The data driving circuit 230 is configured to convert the data signal DATA into a data voltage and to provide a data line DL of the display panel 270 with the data voltage based on the synchronization signal (e.g., synchronization signal of the PSR mode or the synchronization signal of the normal mode).

The gate driving circuit 250 is configured to generate a gate signal and to provide a gate line GL of the display panel 270 with the gate signal based on the synchronization signal (e.g., synchronization signal of the PSR mode or the synchronization signal of the normal mode).

Hereinafter, a method of driving the display system during a start period and an end period of the PSR mode according to an exemplary embodiment of the present inventive concept will be described in more detail.

First, a method of driving the display system during the start period of the PSR mode according to an exemplary embodiment of the present inventive concept will be described.

Figure 2:
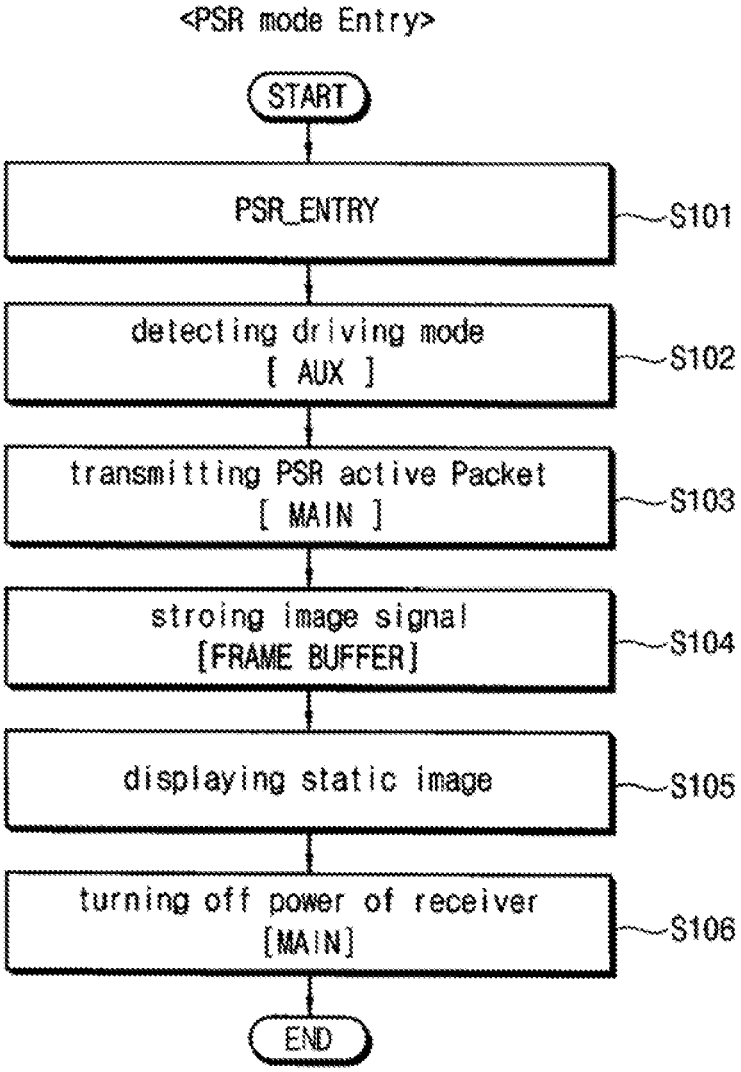
FIG. 2 is a flowchart diagram illustrating a start period of a panel self refresh (PSR) mode according to an exemplary embodiment of the present inventive concept.
Figure 3:
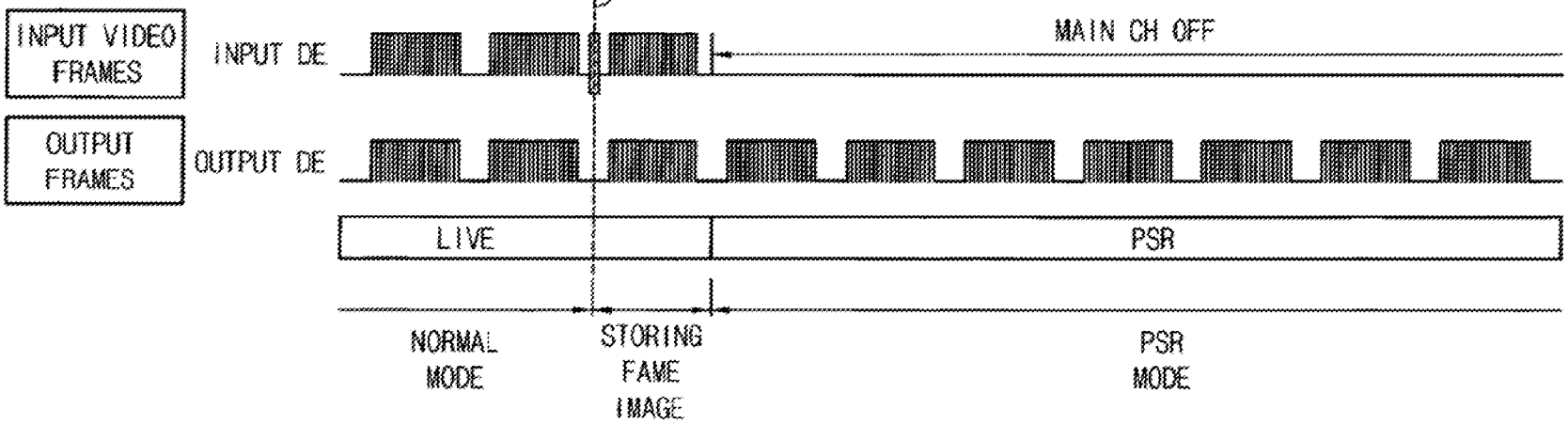
FIG. 3 is a waveform diagram of input and output signals of a timing controller during the start period of the PSR mode according to an exemplary embodiment of the present inventive concept.

FIG. 2 is a flowchart diagram illustrating a start period of a PSR mode according to an exemplary embodiment of the present inventive concept. FIG. 3 is a waveform diagram of input and output signals of a timing controller during the start period of the PSR mode according to an exemplary embodiment of the present inventive concept.

Referring to FIGS. 1 to 3, the graphic processor 100 is configured to transmit a command (e.g., an entry command) for starting the PSR mode to the receiver 212 of the timing controller 210 of the display apparatus 200 based on a control signal PSR_ENTRY. In response to the control signal PSR_ENTRY, a driving mode of the display apparatus 200 is changed from the normal mode to the PSR mode (Step S101). This operation may be referred to as a "PSR mode Entry". The static image may include a text graphic in a state before a text or a cursor is updated when editing a text document.

The graphic processor 100 is configured to detect predetermined values stored in the mode register 217. The graphic processor 100 detects a first value of the predetermined values stored in the mode register 217 (Step S102). Detecting the predetermined value may be performed through the auxiliary channel ACH.

The first controller 110 of the graphic processor 100 is configured to generate a PSR active packet PSR_ACT and to transmit the PSR active packet PSR_ACT to the receiver 212 of the timing controller 210 (Step S103). The PSR active packet PSR_ACT may be transmitted through the main channel MCH.

For example, the PSR active packet PSR_ACT may be transmitted during a vertical blanking period of a frame, as shown in FIG. 3. The timing controller 210 is configured to store an image signal (e.g., a static image signal) of a present frame received through the main channel MCH to the frame buffer 213 in response to the PSR active packet PSR_ACT (Step S104). For example, the frame buffer 213 is configured to store an image signal corresponding to an n-th frame. The image signal corresponding to an n-th frame may correspond to the static image. Here, n is a positive integer.

The timing controller 210 is configured to change the predetermined value of the mode register 217 into a second value corresponding to the PSR mode in response to the PSR active packet PSR_ACT.

For example, when storing the image signal (e.g., the static image signal) corresponding to the n-th frame to the frame buffer 213 is finished, the display apparatus 200 may display the static image (Step S105).

When storing the image signal of the n-th frame to the frame buffer 213 is finished, the graphic processor 100 is configured to transmit an OFF command to the timing controller 210 (Step S106). The OFF command is a command for turning off a power of the receiver 212 such that a communication between the transmitter 120 and the receiver 212 is cut off. The OFF command may be transmitted through the main channel MCH or the auxiliary channel ACH. Therefore, the power of the receiver 212 is turned off and the main channel MCH is blocked. In addition, power of the auxiliary receiver 215 and the auxiliary channel ACH remain turn on state.

The signal generator 216 of the timing controller 210 is configured to generate a synchronization signal (e.g., a data enable signal OUTPUT_DE) of the PSR mode in which the display panel 270 displays the static image. In the PSR mode, the signal generator 216 may be configured to generate the synchronization signal of the PSR mode based on a clock signal generated from an oscillator of the timing controller 210. In an exemplary embodiment of the present inventive concept, the data enable signal OUTPUT_DE corresponding to the PSR mode may be equal to a data enable signal INPUT_DE corresponding to the n-th frame. For example, the data enable signal OUTPUT_DE may have a predetermined frame rate different from that of the data enable signal INPUT_DE corresponding to the n-th frame.

The display apparatus 200 is configured to begin to output the image signal (e.g., the static image signal) corresponding to the n-th frame stored in the frame buffer 213 to the display panel 270 in response to an (n+1)-th frame.

Therefore, the display apparatus 200 begins to be driven according to the PSR mode in response to the (n+1)-th frame such that the static image corresponding to the image signal (e.g., the static image signal) corresponding to the n-th frame is displayed in the display panel 270.

The static image is displayed with the PSR mode in which the receiver 212 is turned off, and thus, electrical power consumption of the display apparatus 200 may be decreased.

In addition, a method of driving the display system during the end period of the PSR mode according to an exemplary embodiment of the present inventive concept will be described.

Figure 4:
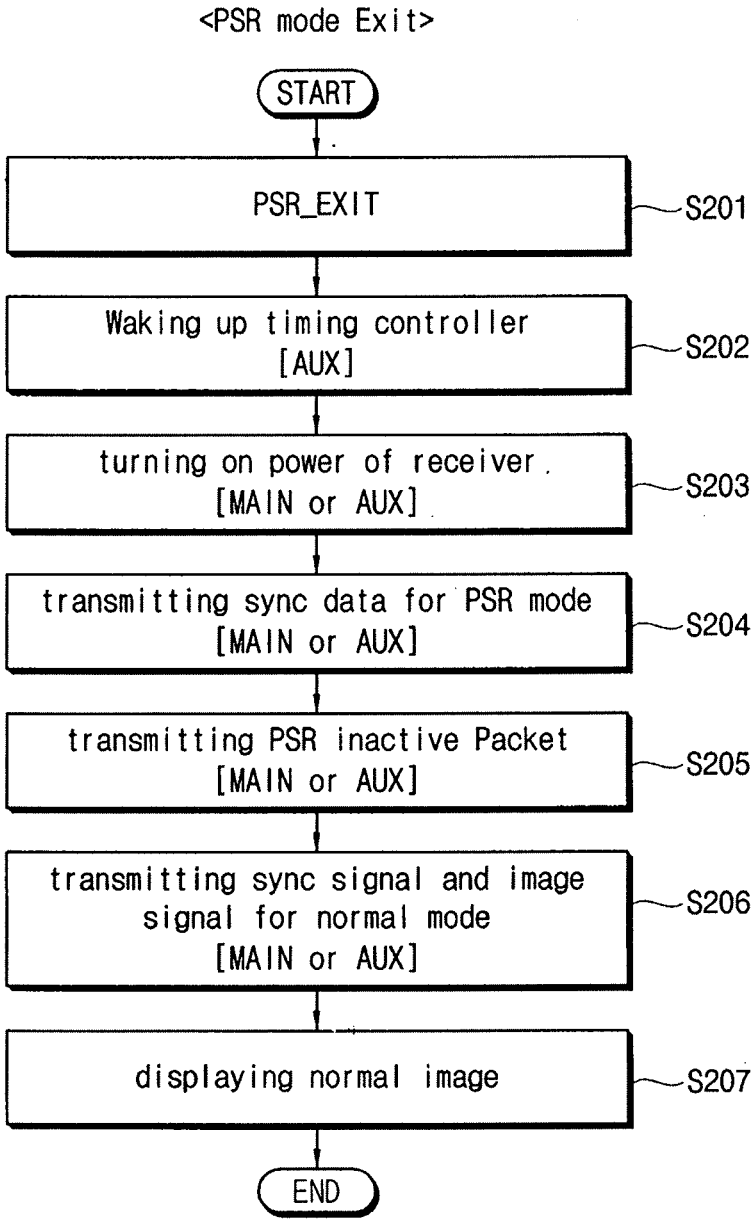
FIG. 4 is a flowchart illustrating an end period of the PSR mode according to an exemplary embodiment of the present inventive concept.
Figure 5:
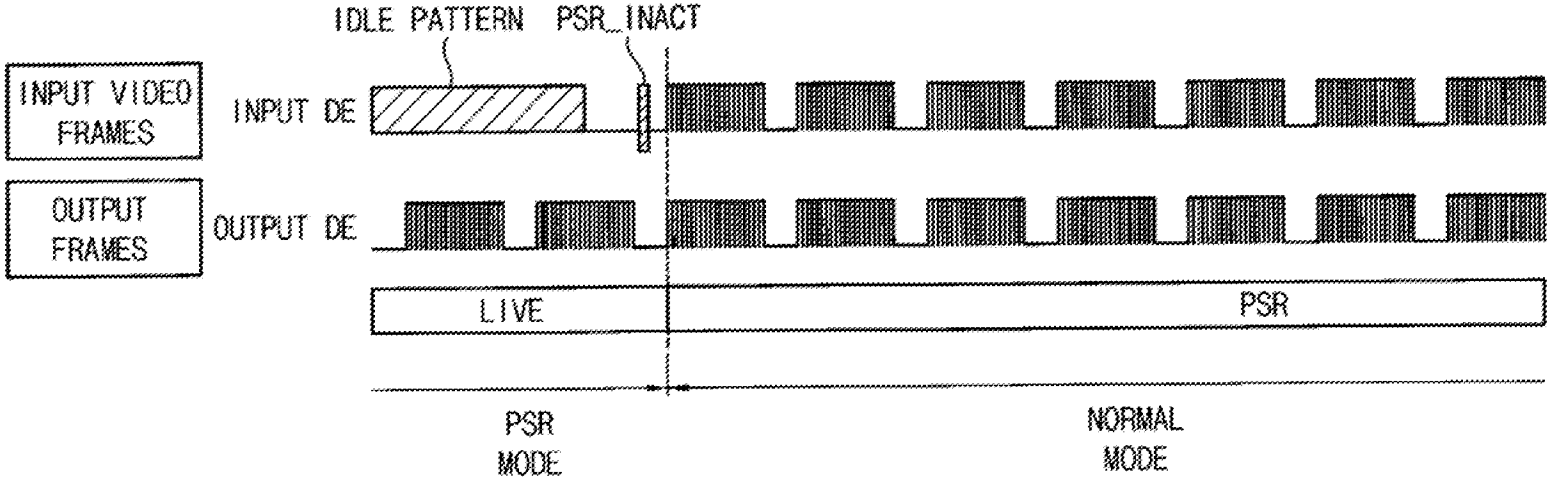
FIG. 5 is a waveform diagram of input and output signals of a timing controller during the end period of the PSR mode according to an exemplary embodiment of the present inventive concept.

FIG. 4 is a flowchart illustrating an end period of the PSR mode according to an exemplary embodiment of the present inventive concept. FIG. 5 is a waveform diagram of input and output signals of a timing controller during the end period of the PSR mode according to an exemplary embodiment of the present inventive concept.

Referring to FIGS. 1, 4 and 5, the graphic processor 100 is configured to transmit a command (e.g., an exit command) for ending the PSR mode to the timing controller 210 of the display apparatus 200 based on a control signal PSR_EXIT. In response to the control signal PSR_EXIT, a driving mode of the display apparatus 200 is changed from the PSR mode to the normal mode (Step S201). This operation may be referred to as a "PSR mode Exit". For example, the exit command may be transmitted through the auxiliary channel ACH.

The graphic processor 100 is configured to transmit a wake-up command to the timing controller 210 through the auxiliary channel ACH which is in a turn-on state during the PSR mode (Step S202). The timing controller 210 may respond to the wake-up command through the auxiliary channel ACH.

The graphic processor 100 is configured to transmit an ON command (for turning on the power source of the receiver 212) to the timing controller 210 when the timing controller 210 wakes up (Step S203). The ON command may be transmitted through the main channel MCH or the auxiliary channel ACH.

According to an exemplary embodiment of the present inventive concept, the timing controller 210 is configured to transmit the synchronization data of the PSR mode (e.g., the frame rate and the synchronization signal of the PSR mode) to the graphic processor 100 (Step S204). Hereinafter, the synchronization data of the PSR mode may be referred to as "PSR synchronization data". The PSR synchronization data may be transmitted to the graphic processor 100 through the main channel MCH or the auxiliary channel ACH. The first controller 110 of the graphic processor 100 is configured to control (or generate) a frame rate and a synchronization signal of the normal mode based on the PSR synchronization data.

The graphic processor 100 is configured to transmit an idle image pattern to the timing controller 210 prior to transmitting an image signal (e.g., a normal image signal) of the normal image.

When the idle image pattern is transmitted, the graphic processor 100 is configured to transmit a PSR inactive packet PSR_INACT to the timing controller 210 (Step S205). The PSR inactive packet PSR_INACT may be transmitted through the main channel MCH or the auxiliary channel ACH. For example, the PSR inactive packet PSR_INACT may be transmitted during a vertical blanking period of a frame, as shown in FIG. 53.

When the PSR inactive packet PSR_INACT is received, the timing controller 210 is configured to change the predetermined value of the mode register MS to the first value corresponding to the normal mode.

After the PSR inactive packet PSR_INACT is transmitted, the graphic processor 100 is configured to start a transmission of the image signal corresponding to the normal image. The image signal corresponding to the normal image may be transmitted to the receiver 212 of the timing controller 210 through the main channel MCH.

The graphic processor 100 is configured to generate a synchronization signal (e.g., a data enable signal INPUT DE) of the normal mode synchronized with the PSR synchronization signal of the PSR mode, and to transmit the generated synchronization signal (e.g., INPUT DE) of the normal mode to the timing controller 210 through the auxiliary channel ACH (Step S206). For example, the graphic processor 100 may generate the synchronization signal (e.g., a data enable signal INPUT DE) of the normal mode based on the synchronization signal of the PSR mode.

The signal generator 216 of the timing controller 210 is configured to generate a synchronization signal (e.g., a data enable signal OUTPUT DE) of the normal mode based on the synchronization signal (e.g., INPUT DE) of the normal mode received from the graphic processor 100 The display apparatus 200 is configured to display the normal image based on the synchronization signal (e.g., OUTPUT DE) of the normal mode generated by the signal generator 216, in synchronization with the synchronization signal of the PSR mode (Step S207).

Therefore, a flicker defect occurring by a change of a frame rate between the PSR mode and the normal mode may be eliminated or decreased.

Figure 6A:
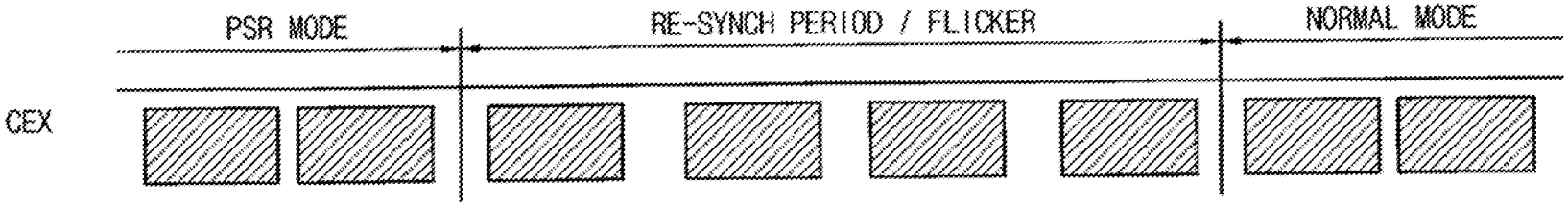
FIG. 6A is a diagram illustrating display images through a display apparatus.
Figure 6B:
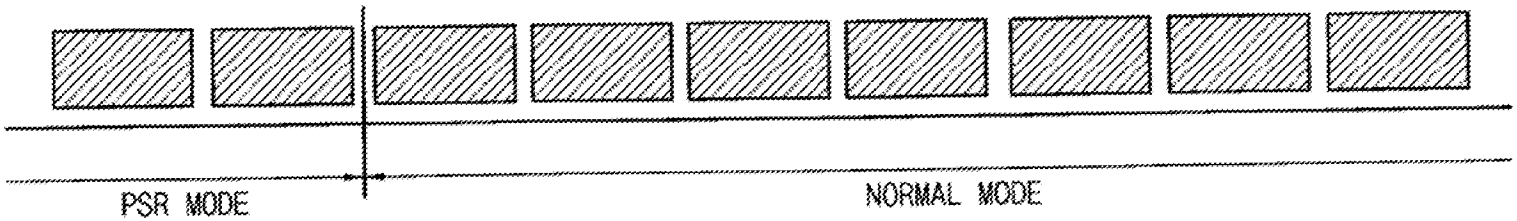
FIG. 6B is a diagram illustrating display images through a display apparatus according to an exemplary embodiment of the present invention.

FIG. 6A is a diagram illustrating display images through a display apparatus, FIG. 6B is a diagram illustrating display images through a display apparatus according to an exemplary embodiment of the present invention.

Referring to FIG. 6A, a display apparatus displays the static image with a frame rate (e.g., 60 Hz) during the PSR mode. When a graphic processor receives a mode control signal PSR_EXIT that changes a driving mode of the display apparatus from the PSR mode to the normal mode, the display apparatus displays a normal image with a predetermined frame rate (for example, 50 Hz) during a re-synchronization period, which corresponds to, for example, about 4 to 5 frames, in response to the mode control signal PSR_EXIT. After the re-synchronization period, the display apparatus displays the normal image with the frame rate of 60 Hz. For example, referring to the display images of FIG. 6A, the frame rate (e.g., 50 Hz) during the re-synchronization period is different from the frame rate (e.g., 60 Hz) during periods of the PSR mode and the normal mode, and thus, the flicker defect occurs due to a difference in frame rate between the re-synchronization period and the period of the PSR mode or between the re-synchronization period and the period of the normal mode.

According to an exemplary embodiment of the present inventive concept, as shown in FIG. 6B, the display apparatus 200 displays the static image with a frame rate (e.g., 60 Hz) during the PSR mode. When the graphic processor 100 receives the mode control signal PSR_EXIT that changes a driving mode of the display apparatus 200 from the PSR mode to the normal mode, the display apparatus 200 transmits the PSR synchronization data to the graphic processor 100. The graphic processor 100 generates the synchronization signal of the normal mode synchronized with the synchronization signal of the PSR mode, and transmits the generated synchronization signal of the normal mode to the display apparatus 200. For example, the graphic processor 100 may generate the synchronization signal of the normal mode based on the synchronization signal of the PSR mode. The display apparatus 200 may display the normal image based on the synchronization signal of the normal mode transmitted from the graphic processor 100, in synchronization with the synchronization signal of the PSR mode. Therefore, display defects (e.g., flickers) occurring due to a de-synchronization between the PSR mode and the normal mode may be eliminated or decreased. In addition, according to an exemplary embodiment of the present inventive concept, the re-synchronization period positioned between the PSR mode and the normal mode as described with reference to FIG. 6A may be omitted, and thus, the flicker defect may be eliminated or decreased.

Figure 7:
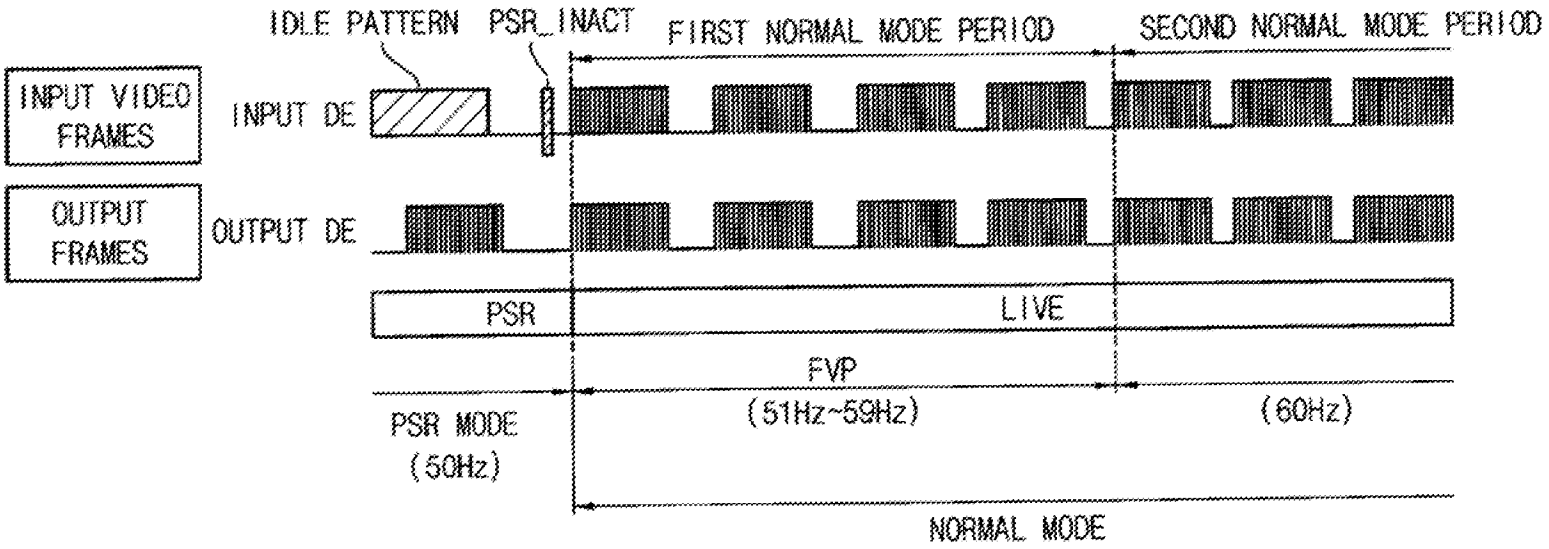
FIG. 7 is a waveform diagram of input and output signals of a timing controller during the end period of the PSR mode according to an exemplary embodiment of the present inventive concept.

FIG. 7 is a waveform diagram of input and output signals of a timing controller during the end period of the PSR mode according to an exemplary embodiment of the present inventive concept.

Referring to FIGS. 1 and 7, a method of driving the display system is described when the display image is changed from the static image with a first frame rate (e.g., 50 Hz) to the normal image (e.g., a moving image) with a second frame rate (e.g., 60 Hz).

When the mode control signal PSR_EXIT for changing a display image from the static image with the first frame rate (e.g., 50 Hz) to the normal image with the second frame rate (e.g., 60 Hz) is received (e.g., PSR mode Exit operation begins), the graphic processor 100 is configured to transmit an exit command for ending the PSR mode to the timing controller 210 of the display apparatus 200 based on the mode control signal PSR_EXIT.

The graphic processor 100 is configured to transmit a wake-up command to the timing controller 210 through the auxiliary channel ACH which is in a turn-on state during the PSR mode. The timing controller 210 may respond to the wake-up command through the auxiliary channel ACH.

The graphic processor 100 is configured to transmit an ON command for turning on the power source of the receiver 212 to the timing controller 210, when the timing controller 210 wakes up. The ON command may be transmitted through the main channel MCH or the auxiliary channel ACH.

According to an exemplary embodiment of the present inventive concept, the timing controller 210 is configured to transmit the synchronization data of the PSR mode (e.g., the frame rate of 50 Hz and the synchronization signal of the PSR mode) to the graphic processor 100. The PSR synchronization data may be transmitted to the graphic processor 100 through the main channel MCH or the auxiliary channel ACH.

The graphic processor 100 is configured to transmit an idle image pattern to the timing controller 210 prior to transmitting an image signal (e.g., a normal image signal) of the normal image with the second rate (e.g., 60 Hz).

When the idle image pattern is transmitted, the graphic processor 100 is configured to transmit a PSR inactive packet PSR_INACT to the timing controller 210. The PSR packet PSR_INACT may be transmitted through the main channel MCH or the auxiliary channel ACH. For example, the PSR inactive packet PSR_INACT may be transmitted in a vertical blanking period of a frame, as shown in FIG. 7.

When the PSR inactive packet PSR_INACT is received, the timing controller 210 is configured to change the predetermined value in the mode register MS to the first value corresponding to the normal mode of the display apparatus 200.

After the PSR enactive packet PSR_INACT is transmitted, the graphic processor 100 is configured to start a transmission of the image signal corresponding to the normal image. The image signal corresponding to the normal image may be transmitted to the receiver 212 of the timing controller 210 through the main channel MCH.

The graphic processor 100 is configured to generate a plurality of synchronization signals of the normal mode based on the synchronization data of the PSR mode (e.g., the frame rate and the synchronization signal of the PSR mode). The plurality of synchronization signals of the normal mode may correspond to a plurality of frame rates, respectively, which is gradually changed from the first frame rate (e.g., 50 Hz) corresponding to the static image to the second frame rate (e.g., 60 Hz) corresponding to the normal image during a predetermined period FVP (e.g., a first normal mode period) disposed between the PSR mode driven with the first frame rate and the normal mode driven with the second frame rate. For example, the graphic processor 100 may sequentially generate the synchronization signals of the normal mode based on the synchronization data of the PSR mode. The graphic processor 100 is configured to transmit the synchronization signals generated to respectively correspond to the plurality of frame rates during the predetermined period FVP to the timing controller 210.

Referring to FIG. 7, during the first normal mode period (e.g., the period FVP), the timing controller 210 is configured to display the normal images on the display panel 270 based on the synchronization signals of the normal mode respectively corresponding to the plurality of frame rates ranging between the first frame rate (e.g., 50 Hz) and the second frame rate (e.g., 60 Hz). For example, during a second normal mode period subsequent to the first normal mode period, the timing controller 210 may be configured to display the normal images on the display panel 270 based on a synchronization signal corresponding to the second frame rate (e.g., 60 Hz).

Therefore, when the driving mode of the display apparatus 200 is changed from the PSR mode to the normal mode, the display panel 270 sequentially displays the static images with the first frame rate (e.g., 50 Hz), the normal images with the frame rates (e.g., 51 Hz to 59 Hz) changing between the first frame rate and the second frame rate (e.g., 60 Hz), and the normal images with the second frame rate.

According to an exemplary embodiment of the present inventive concept, a plurality of normal images, frame rates of which are gradually changed from the first frame rate (e.g., 50 Hz) of the static image to the second frame rate (e.g., 60 Hz) of the normal image, is inserted between the PSR mode in which the static image is displayed with the first frame rate and the normal mode in which the normal image is displayed with the second frame rate, and thus, the flicker defect of the display apparatus 200 may be eliminated or decreased. Although FIG. 7 illustrates that frame rates of a static image and a normal image are 50 Hz and 60 Hz, respectively, the present inventive concept is not limited thereto.

Figure 8A:
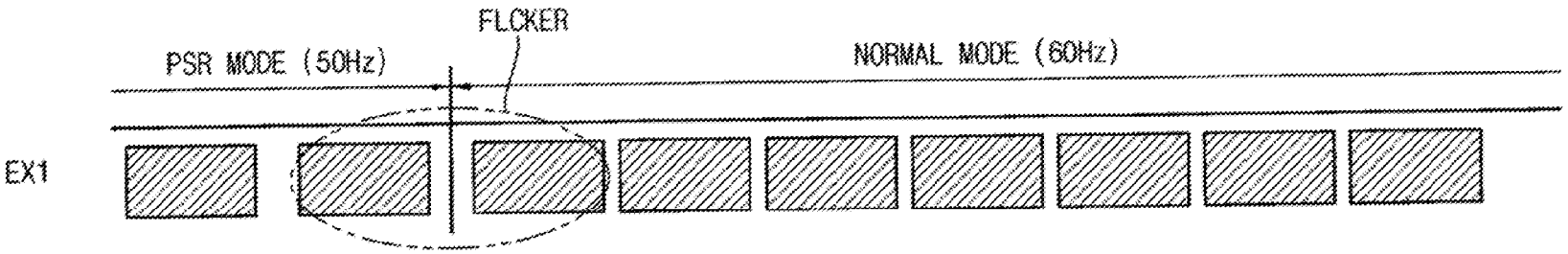
FIGS. 8A and 8B are diagrams illustrating display images through a display apparatus according to an exemplary embodiment of the present inventive concept.
Figure 8B:
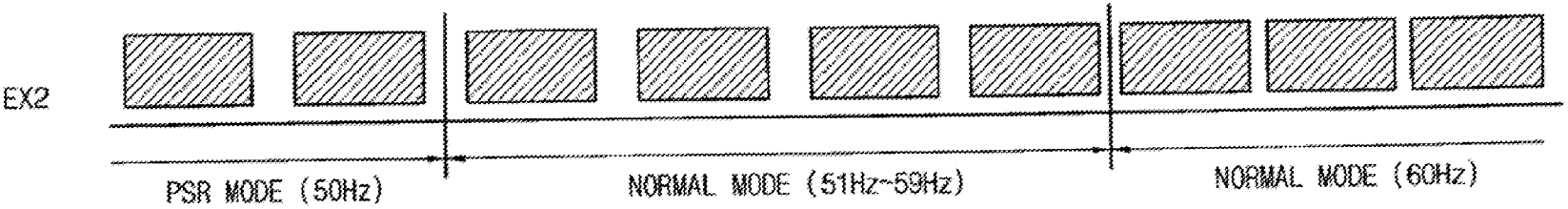

FIGS. 8A and 8B are diagrams illustrating display images through a display apparatus according to an exemplary embodiment of the present inventive concept.

Referring to FIG. 8A, when a driving mode of a display apparatus is changed from the PSR mode in which the static image is displayed with the first frame rate (e.g., 50 Hz) to the normal mode in which the normal image is displayed with the second frame rate (e.g., 60 Hz), the graphic processor (e.g., 100 of FIG. 1) receives the synchronization data of the PSR mode (e.g., the first frame rate of 50 Hz and the synchronization signal having the first frame rate) from the display apparatus in response to the mode control signal PSR_EXIT. In addition, the graphic processor generates a synchronization signal of 60 Hz synchronized with the synchronization signal of 50 Hz, which, for example, included in the synchronization data of the PSR mode received from the display apparatus, and transmits the generated synchronization signal of 60 Hz to the display apparatus. For example, the graphic processor may generate the synchronization signal of 60 Hz based on the synchronization signal of 50 Hz. The display apparatus displays the normal image with the second frame rate (e.g., 60 Hz) based on the synchronization signal of 60 Hz generated through the graphic processor, in synchronization with the synchronization signal of 50 Hz.

Referring to FIG. 8B, when a driving mode of a display apparatus (e.g., 200 of FIG. 1) is changed from the PSR mode in which the static image is displayed with the first frame rate (e.g., 50 Hz) to the normal mode in which the normal image is displayed with the second frame rate (e.g., 60 Hz), the graphic processor (e.g., 100 of FIG. 1) receives the synchronization data (e.g., the first frame rate and the synchronization signal having the first frame rate) of the PSR mode from the display apparatus in response to the mode control signal PSR_EXIT. In addition, the graphic processor generates a plurality of synchronization signals respectively corresponding to a plurality of frame rates based on the synchronization data (e.g., the first frame rate and the synchronization signal having the first frame rate) of the PSR mode. The plurality of frame rates may be increased in a gradual manner from the first frame rate (e.g., 50 Hz) corresponding to the static image to the second frame rate (e.g., 60 Hz) corresponding to the normal image during a predetermined period FVP disposed between the PSR mode and the normal mode. For example, the graphic processor may sequentially generate the synchronization signals respectively corresponding to the plurality of frame rates (e.g., 51 Hz to 59 Hz) based on the synchronization data of the PSR mode. The graphic processor transmits the generated synchronization signals respectively corresponding to the plurality of frame rates during the predetermined period to the timing controller (e.g., 210 of FIG. 1).

Referring back to FIG. 8A, when the driving mode of the display apparatus is changed from the PSR mode in which the static image is displayed with the first frame rate (e.g., 50 Hz) to the normal mode in which the normal image is displayed with the second frame rate (e.g., 60 Hz), the frame rate may suddenly be changed from the first frame rate (e.g., 50 Hz) corresponding to the PSR mode and of the second frame rate corresponding to the normal mode (e.g., 60 Hz), and thus, the flicker defect may occur due to the abrupt change in the frame rate. According to an exemplary embodiment of the present inventive concept described with reference to FIG. 8B, a plurality of normal images, frame rates of which are gradually changed from the first frame rate (e.g., 50 Hz) of the static image to the second frame rate (e.g., 60 Hz) of the normal image, is inserted between the PSR mode driven with the first frame rate (e.g., 50 Hz) and the normal mode driven with the second frame rate (e.g., 60 Hz), and thus, the flicker defect may be eliminated or decreased. Although FIG. 8 illustrates that frame rates of a static image and a normal image are 50 Hz and 60 Hz, respectively, the present inventive concept is not limited thereto.

As described above, according to an exemplary embodiment of the present inventive concept, when the driving mode of the display apparatus (e.g., 200 of FIG. 1) is changed from the PSR mode to the normal mode, the display apparatus transmits synchronization data (e.g., the frame rate and the synchronization signal) of the PSR mode to the graphic processor (e.g., 100 of FIG. 1). The graphic processor generates a synchronization signal of the normal mode synchronized with the synchronization signal of the PSR mode, which is received from, e.g., the display apparatus, and transmits the generated synchronization signal of the normal mode to, e.g., the display apparatus (e.g., 200 of FIG. 1). For example, the graphic processor may generate the synchronization signal of the normal mode based on the synchronization signal of the PSR mode. Therefore, the display apparatus displays a normal image based on the synchronization signal of the normal mode generated in synchronization with the synchronization signal of the PSR mode, and thus, display defects (e.g., flickers) occurring due to a change of the frame rate between the PSR mode and the normal mode may be eliminated or decreased.

The foregoing is illustrative of exemplary embodiments of the present inventive concept and the present inventive concept should not be construed as being limiting to the exemplary embodiments disclosed herein. Although a few exemplary embodiments of the present inventive concept have been described, it will be understood that various modifications in forms and detail may be made therein without departing from the spirit and scope of the present invention.

What is claimed is:

1. A display system comprising:

a graphic processor configured to supply a first image signal and a first synchronization signal corresponding to a second frame rate; and a display apparatus configured to: be driven in a normal mode, in which a first image is displayed, during a first period, based on the first image signal and the first synchronization signal provided from the graphic processor; to be driven in a panel self refresh (PSR) mode, in which a second image is displayed, based on a second image signal stored in a frame buffer of the display apparatus and a second synchronization signal, corresponding to a first frame rate, generated in the display apparatus; and to transmit the second synchronization signal of the PSR mode to the graphic processor when a driving mode of the display apparatus is changed from the PSR mode to the normal mode, wherein the graphic processor is configured to generate a third synchronization signal of the normal mode during a second period disposed between a period of the PSR mode and the first period, and corresponding to a frame rate that gradually changes from the first frame rate to the second frame rate.

2. The display system of claim 1, wherein the display apparatus includes a timing controller configured to transmit the second synchronization signal to the graphic processor.

3. The display system of claim 1, wherein the second frame rate is higher than the first frame rate, and the frame rate of the third synchronization signal gradually increases from the first frame rate to the second frame rate.

4. The display system of claim 1, wherein the first image signal is transmitted through a main channel, and the first synchronization signal is transmitted through an auxiliary channel.

5. The display system of claim 4, wherein the second synchronization signal is transmitted through the main channel or the auxiliary channel.

6. The display system of claim 1, wherein the first image signal and the first synchronization signal are transmitted through an interface based on a display port (DP) standard.

7. The display system of claim 1, wherein the first image includes a moving image, and the second image includes a static image.

8. The display system of claim 1, wherein the second period of the normal mode is a period during which about four or five frames are output.

9. A method of driving a display apparatus comprising:

driving the display apparatus in a first period of a normal mode, in which a first image is displayed, based on a first image signal and a first synchronization signal corresponding to a second frame rate, the first image signal and the first synchronization signal being provided by a graphic processor;

driving the display apparatus in a panel self refresh (PSR) mode in which a second image signal stored in a frame buffer of the display apparatus is displayed based on a second synchronization signal corresponding to a first frame rate and generated in the display apparatus;

transmitting the second synchronization signal to the graphic processor when a driving mode of the display apparatus is changed from the PSR mode to the normal mode; and driving the display apparatus during a second period of the normal mode, based on a third synchronization signal corresponding to a frame rate that gradually changes from the first frame rate to the second frame rate, where the second period is disposed between a period of the PSR mode and the first period.

10. The method of claim 9, wherein the second frame rate is higher than the first frame rate, and the frame rate of the third synchronization signal gradually increases from the first frame rate to the second frame rate.

11. The method of claim 9, wherein the first image signal is transmitted through a main channel, and the first synchronization signal is transmitted through an auxiliary channel.

12. The method of claim 11, wherein the second synchronization signal is transmitted through the main channel or the auxiliary channel.

13. The method of claim 11, wherein the first image signal and the first synchronization signal are transmitted through an interface based a display port (DP) standard.

14. A method of driving a display system including a graphic processor and a display apparatus comprising:

detecting, using the graphic processor, a driving mode of the display apparatus by detecting a predetermined value of a mode register of the display apparatus;

receiving an entry command from the graphic processor using a first receiver of the display apparatus;

changing the driving mode from a normal mode, in which a first image is displayed based on a second synchronization signal corresponding to a second frame rate, to a panel self refresh (PSR) mode, in which a second image is displayed, in response to the received entry command;

storing a second image signal corresponding to the second image to a buffer in response to a PSR packet received from the graphic processor through the first receiver;

receiving an off-command from the graphic processor using the display apparatus;

turning off the first receiver connected to the graphic processor through a main channel in response to the received off-command;

maintaining a turn-on state of a second receiver of the display apparatus in response to the received off command, the second receiver connected to the graphic processor through an auxiliary channel;

generating a first synchronization signal of the PSR mode corresponding to a first frame rate, based on a clock signal generated in the display apparatus;

displaying the second image through a display panel of the display apparatus when the first receiver is turned off; and driving the display system during a second period of the normal mode disposed between a period of the PSR mode and a first period of the normal mode, based on a third synchronization signal corresponding to a frame rate that gradually changes from a first frame rate of the PSR mode to a second frame rate of the first period of the normal mode.

15. The method of claim 14, wherein the first image is a moving image, and the second image is a static image.

16. The method of claim 14, wherein the PSR packet is transmitted during a vertical blanking period of a frame of the PSR mode.

17. The method of claim 14, further comprising:

changing the driving mode of the display apparatus from the PSR mode to a normal mode in response to an exit command received from the graphic processor; and turning on the first receiver in response to an on-command received from the graphic processor.

18. The method of claim 17, further comprising:

transmitting, using the display apparatus, the first synchronization signal of the PSR mode to the graphic processor; and generating, using the graphic processor, a second synchronization signal of the normal mode based on the first synchronization signal.

19. The method of claim 18, wherein the second synchronization signal is synchronized with the first synchronization signal.

20. The method of claim 14, wherein the second frame rate is higher than the first frame rate, and the frame rate of the third synchronization signal gradually increases from the first frame rate to the second frame rate.

21. A display system comprising:

a graphic processor configured to supply a first image signal and a first synchronization signal; and a display apparatus configured to: be driven in a normal mode, in which a first image is displayed, during a first period, based on the first image signal and the first synchronization signal provided from the graphic processor; to be driven in a panel self refresh (PSR) mode, in which a second image is displayed, based on a second image signal stored in a frame buffer of the display apparatus and a second synchronization signal generated in the display apparatus; and to transmit the second synchronization signal of the PSR mode to the graphic processor when a driving mode of the display apparatus is changed from the PSR mode to the normal mode, wherein the graphic processor is configured to generate the first synchronization signal in synchronous with the second synchronization signal, wherein a re-synchronization period does not exist between a period of the PSR mode and the first period when the driving mode of the display apparatus is changed from the PSR mode to the normal mode.

* * * * *